US009337528B2

(12) United States Patent
Hammond

(10) Patent No.: US 9,337,528 B2
(45) Date of Patent: May 10, 2016

(54) MOBILE WIRELESS COMMUNICATIONS DEVICE INCLUDING ELECTRICALLY CONDUCTIVE PORTABLE HOUSING SECTIONS DEFINING AN ANTENNA

(75) Inventor: Robert Ralph Bryan Hammond, Ottawa (CA)

(73) Assignee: BlackBerry Limited, Waterloo (CA)

( * ) Notice: Subject to any disclaimer, the term of this patent is extended or adjusted under 35 U.S.C. 154(b) by 310 days.

(21) Appl. No.: 13/360,197

(22) Filed: Jan. 27, 2012

(65) Prior Publication Data

US 2013/0194138 A1 Aug. 1, 2013

(51) Int. Cl.

| | |
|---|---|
| ***H01Q 1/24*** | (2006.01) |
| ***H01Q 13/10*** | (2006.01) |
| ***H01Q 1/00*** | (2006.01) |
| ***H01Q 1/44*** | (2006.01) |

(52) U.S. Cl.
CPC ..... *H01Q 1/243* (2013.01); *H01Q 1/44* (2013.01); *H01Q 13/10* (2013.01)

(58) Field of Classification Search
CPC ..... H01Q 1/24; H01Q 1/243; H01Q 5/0058; H01Q 1/44
USPC ..... 343/702
See application file for complete search history.

(56) References Cited

U.S. PATENT DOCUMENTS

| | | | | |
|---|---|---|---|---|
| 7,286,090 | B1 * | 10/2007 | Rowell | 343/702 |
| 7,592,963 | B2 | 9/2009 | Cheng | |
| 7,619,577 | B1 | 11/2009 | Cheng | |
| 8,054,231 | B2 | 11/2011 | Ahn et al. | |
| 2004/0257283 | A1 | 12/2004 | Asano et al. | |
| 2008/0238780 | A1 * | 10/2008 | Ponce De Leon et al. MS | 343/700 |
| 2009/0153423 | A1 * | 6/2009 | Dinallo et al. | 343/767 |
| 2010/0053002 | A1 | 3/2010 | Wojack et al. | |
| 2012/0009983 | A1 * | 1/2012 | Mow et al. | 455/575.7 |
| 2012/0206302 | A1 * | 8/2012 | Ramachandran et al. | 343/702 |
| 2012/0229347 | A1 * | 9/2012 | Jin et al. | 343/702 |

FOREIGN PATENT DOCUMENTS

| | | |
|---|---|---|
| EP | 2146413 | 1/2010 |
| EP | 2405534 | 1/2012 |
| EP | 2410605 | 1/2012 |
| WO | 2011106899 | 9/2011 |

* cited by examiner

*Primary Examiner* — Dameon E Levi
*Assistant Examiner* — Ricardo Magallanes
(74) *Attorney, Agent, or Firm* — Jenna L. Wilson; Dimock Stratton LLP

(57) ABSTRACT

A mobile wireless communications device may include a portable housing including electrically conductive sections defining a perimeter of the portable housing and configured to function as an antenna. One of the electrically conductive sections may include a base, a first electrically conductive arm extending from the base, and a second electrically conductive arm having a proximal portion parallel and spaced apart from the first electrically conductive arm. A printed circuit board (PCB) may be carried by the portable housing. The mobile wireless communications device may also include wireless transceiver circuitry carried by the PCB and coupled to the antenna.

20 Claims, 6 Drawing Sheets

MOBILE WIRELESS COMMUNICATIONS DEVICE INCLUDING ELECTRICALLY CONDUCTIVE PORTABLE HOUSING SECTIONS DEFINING AN ANTENNA

TECHNICAL FIELD

The present disclosure generally relates to the field of wireless communications systems, and, more particularly, to mobile wireless communications devices and related methods.

BACKGROUND

Mobile wireless communications systems continue to grow in popularity and have become an integral part of both personal and business communications. For example, cellular telephones allow users to place and receive voice calls almost anywhere they travel, while tablet personal computers allow mobile data communications almost anywhere. Moreover, as mobile communications technology, for example, cellular communications technology, has increased, so too has the functionality of cellular devices and the different types of devices available to users. For example, many cellular devices now incorporate personal digital assistant (PDA) features such as calendars, address books, task lists, etc. Moreover, such multi-function devices, including, for example, tablet personal computers, may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for antennas and within operating guidelines for a given device.

DETAILED DESCRIPTION

Figure 1:
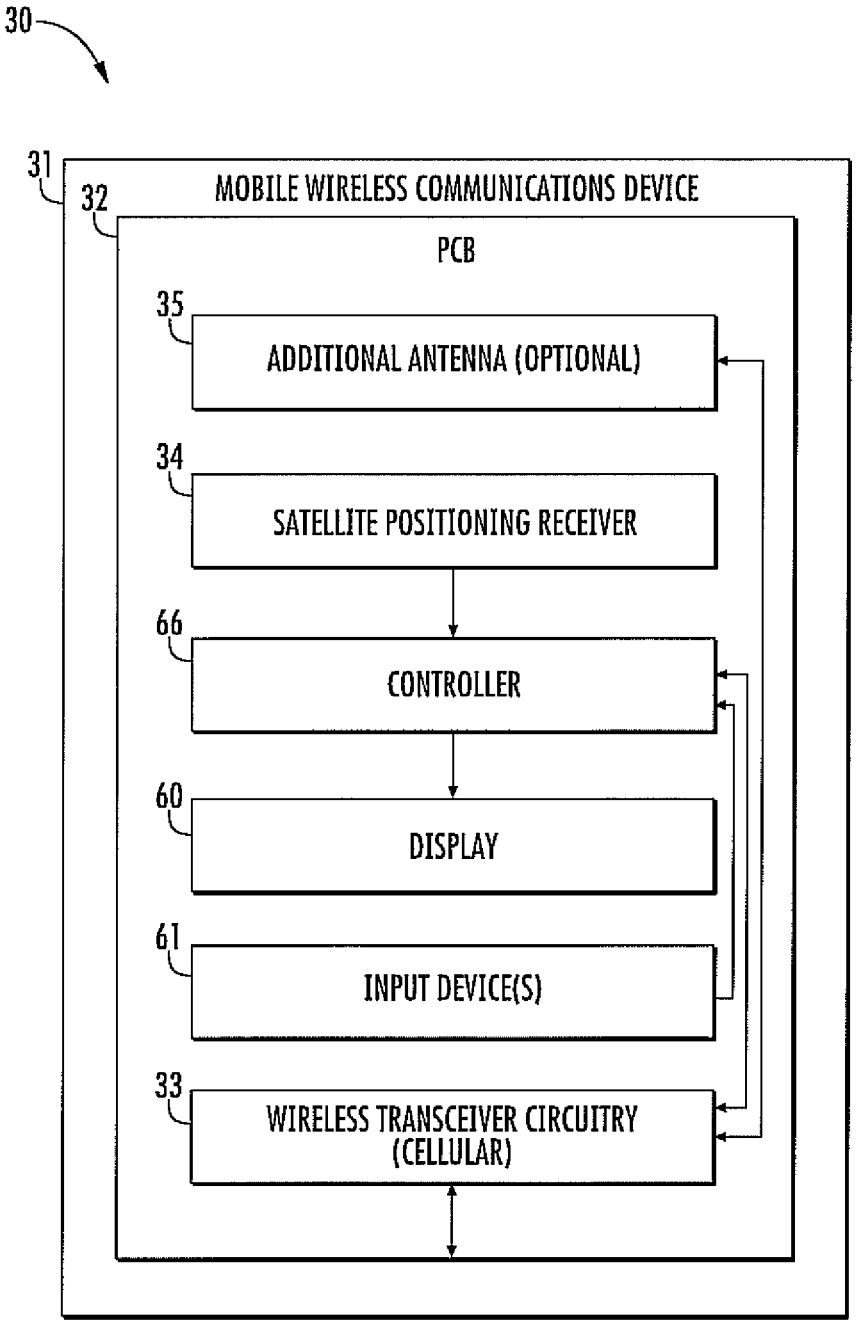
FIG. 1 is a schematic block diagram of a portion of a mobile wireless communications device including an electrically conductive perimeter section in accordance with one example embodiment.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements or steps in alternative embodiments.

In accordance with one exemplary aspect, a mobile wireless communications device may include a portable housing including a plurality of electrically conductive sections defining a perimeter of the portable housing and configured to function as an antenna, for example. One of the electrically conductive sections may include a base, a first electrically conductive arm extending from the base, and a second electrically conductive arm having a proximal portion parallel and spaced apart from the first electrically conductive arm. A printed circuit board (PCB) may be carried by the portable housing. The mobile wireless communications device may also include wireless transceiver circuitry carried by the PCB and coupled to the antenna, for example.

At least one pair of adjacent electrically conductive sections may have a discontinuity therebetween, for example. The mobile wireless communications device may further include at least one dielectric body within the discontinuity.

The second electrically conductive arm may have a U-shaped distal portion coupled to the proximal portion, for example. The U-shaped distal portion may be aligned with the first electrically conductive arm and the proximal portion.

The proximal portion being parallel and spaced apart from the first electrically conductive may define a gap, for example. The mobile wireless communications device may further include a dielectric body in the gap, for example.

The first electrically conductive arm may have an elongate shape. The first and second electrically conductive arms may define a planar inverted F-antenna (PIFA), for example.

At least one of the first and second electrically conductive arms may have an opening therein. The first and second electrically conductive arms may be adjacent at least one of a top and a bottom of the portable housing, for example. The plurality of electrically conductive sections may be configured to function as a cellular antenna, for example.

A method aspect is directed to a method of making a mobile wireless communications device that may include a portable housing that may include a plurality of electrically conductive sections defining a perimeter of the portable housing and configured to function as an antenna. The mobile wireless communications device may further include a printed circuit board (PCB) carried by the portable housing, and wireless transceiver circuitry carried by the PCB and coupled to the antenna, for example. The method may include forming one of the electrically conductive sections to include a base, a first electrically conductive arm extending from the base, and a second electrically conductive arm having a proximal portion parallel and spaced apart from the first electrically conductive arm.

Figure 2:
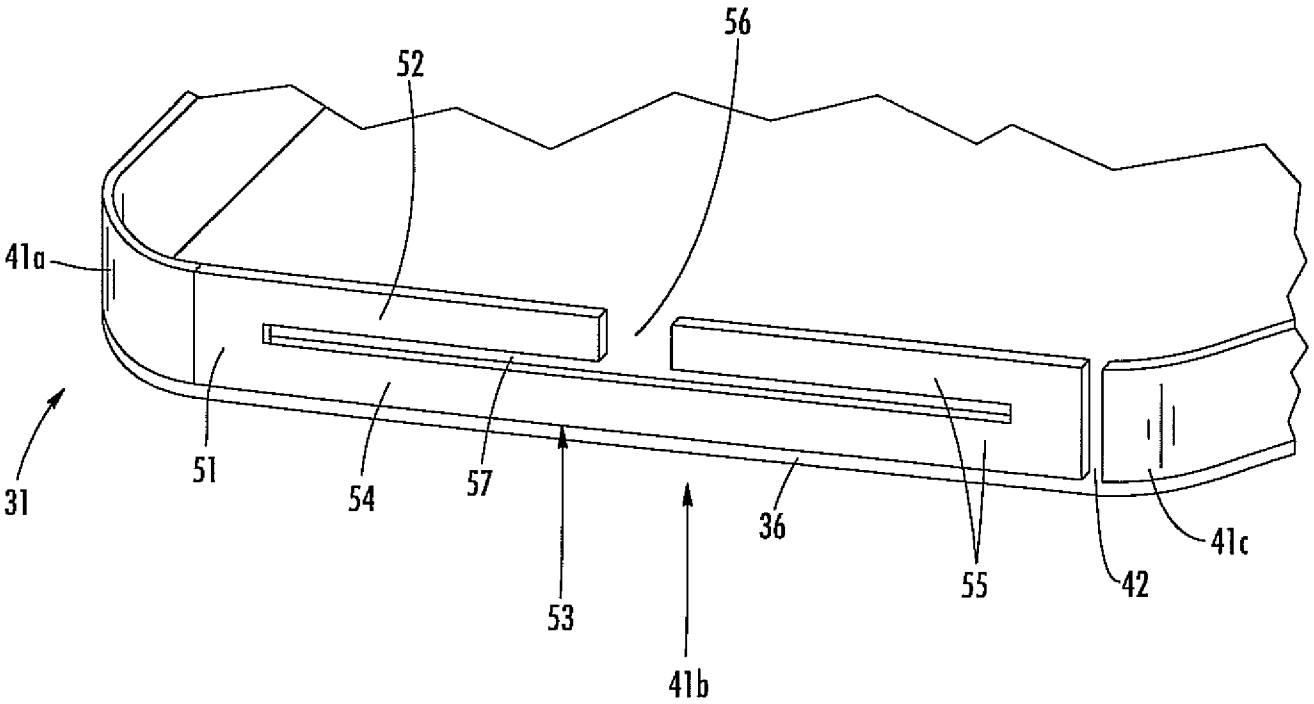
FIG. 2 is a detailed perspective view of a portion of the device of FIG. 1.

Referring initially to FIGS. 1-2, a mobile wireless communications device 30 illustratively includes a portable housing 31, a printed circuit board (PCB) 32 carried by the portable housing, and wireless transceiver circuitry 33 carried by the portable housing. In other embodiments, the PCB 32 may be used in conjunction with a metal chassis or other substrate. The PCB 32 may also include a conductive layer defining a ground plane (not shown).

A satellite positioning signal receiver 34 is also carried by the portable housing 31. The satellite positioning signal receiver 34 may be a Global Positioning System (GPS) satellite receiver, for example.

The exemplary device 30 further illustratively includes a display 60 and one or more input devices 61, which may be in the form of control keys including an "off hook" (i.e., initiate phone call) key, an "on hook" (i.e., discontinue phone call) key, a menu key, and a return or escape key, for example. While the input devices 61 are illustratively carried by the PCB 32, it should be noted that input devices may alternatively or additionally be carried by the portable housing 31. Operation of the various device components and input keys, etc., will be described further below with reference to FIG. 6.

A controller 66 or processor may also be carried by the PCB 32. The controller 66 may cooperate with the other components, for example, the satellite positioning signal receiver 34, and the wireless transceiver circuitry 33 to coordinate and control operations of the mobile wireless communications device 30. Operations may include mobile voice and data operations, including email and Internet data. One or more other components may be carried by the PCB 32. For example, other components may include a headphone jack, a power port, a microphone, a speaker, etc.

The portable housing 31 includes electrically conductive sections 41*a*-41*c* that define a perimeter of the portable housing 31. For example, the portable housing 31 may be metallic and include metallic sections. The portable housing 31 illustratively includes a discontinuity 42 therein defining a break between adjacent electrically conductive sections 41*b*, 41*c*. Of course, in some embodiments, the portable housing 31 may be continuous, and other features may define the different electrically conductive sections 41*a*-41*c*. Moreover, the portable housing 31 may include any number of electrically conductive sections. The portable housing 31 also includes a dielectric cover 36, for example, plastic, defining a back of the mobile wireless communications device 30. As will be appreciated by those skilled in the art, when a portable housing 31 includes electrically conductive sections, one or more of the electrically conductive sections may function as an antenna.

Illustratively, the electrically conductive sections 41*a*-41*c* function as an antenna. In particular, one of the electrically conductive sections 41*b* is carried adjacent the bottom of the portable housing 31 and is coupled to the wireless transceiver circuitry 33 via PCB clip, for example, and functions as an antenna. The antenna may transmit or receive at different operating frequencies, for example, cellular telephone, satellite, or other wireless communications frequencies.

The mobile wireless communications device 30 may include an additional or second antenna 35 coupled to the wireless transceiver circuitry 33, which may be carried adjacent the top of the portable housing 31. The second antenna 35 may also be configured to transmit or receive at different operating frequencies, for example, cellular telephone, satellite, or other wireless communications frequencies, and may operate independently or in conjunction with the electrically conductive portion of the portable conductive housing 31 that is configured as an antenna. Of course, the electrically conductive section 41*b* may be positioned at a different location, for example, at the top of the portable housing 31.

The electrically conductive section 41*b* illustratively includes a base 51 adjacent a corner of the portable housing 31. A first electrically conductive arm 52 extends from the base 51 and may be considered one arm of a planar inverted F-antenna (PIFA), as will be appreciated by those skilled in the art. The first electrically conductive arm 52 is illustratively elongate in shape and extends about halfway across the width of the portable housing 31. The length of the first electrically conductive arm 52 determines an operating frequency, for example, a cellular frequency that may be in the range of 800-900 MHz and/or 1850-2000 MHz. As will be appreciated by those skilled in the art, the length of the first electrically conductive arm 52 may be adjusted to correspond to a different operating frequency range.

The electrically conductive section 41*b* also includes a second electrically conductive arm 53 having a proximal portion 54 parallel and spaced apart from the first electrically conductive arm 52. The second electrically conductive arm 53 also includes a U-shaped distal portion 55 coupled to the proximal portion 54. The U-shaped distal portion 55 is aligned with the first electrically conductive arm 52 and the proximal portion 54. In other words, the distal portion 55 couples to the proximal portion 54 and loops back around to just short of a distal end of the first electrically conductive arm 52 to define a gap 56 therebetween. The second electrically conductive arm 53 may be considered a second arm of a PIFA, for example. The length of the second electrically conductive arm 53 also advantageously determines an operating frequency, for example, a cellular frequency that may be in the range of 800-900 MHz and/or 1850-2000 MHz. As will be appreciated by those skilled in the art, the length of the second electrically conductive arm 53 may also be adjusted to correspond to a different operating frequency range.

The first electrically conductive arm 52, the proximal portion 54, and the parallel portion of the distal portion 55 define another gap 57. The size of the gaps 56, 57 are based upon a size or dimensions of the first and second electrically conductive arms 51, 52. Accordingly, the size of the gaps 56, 57 may change based upon the desired operating frequencies, or desired bandwidth.

Figure 3:
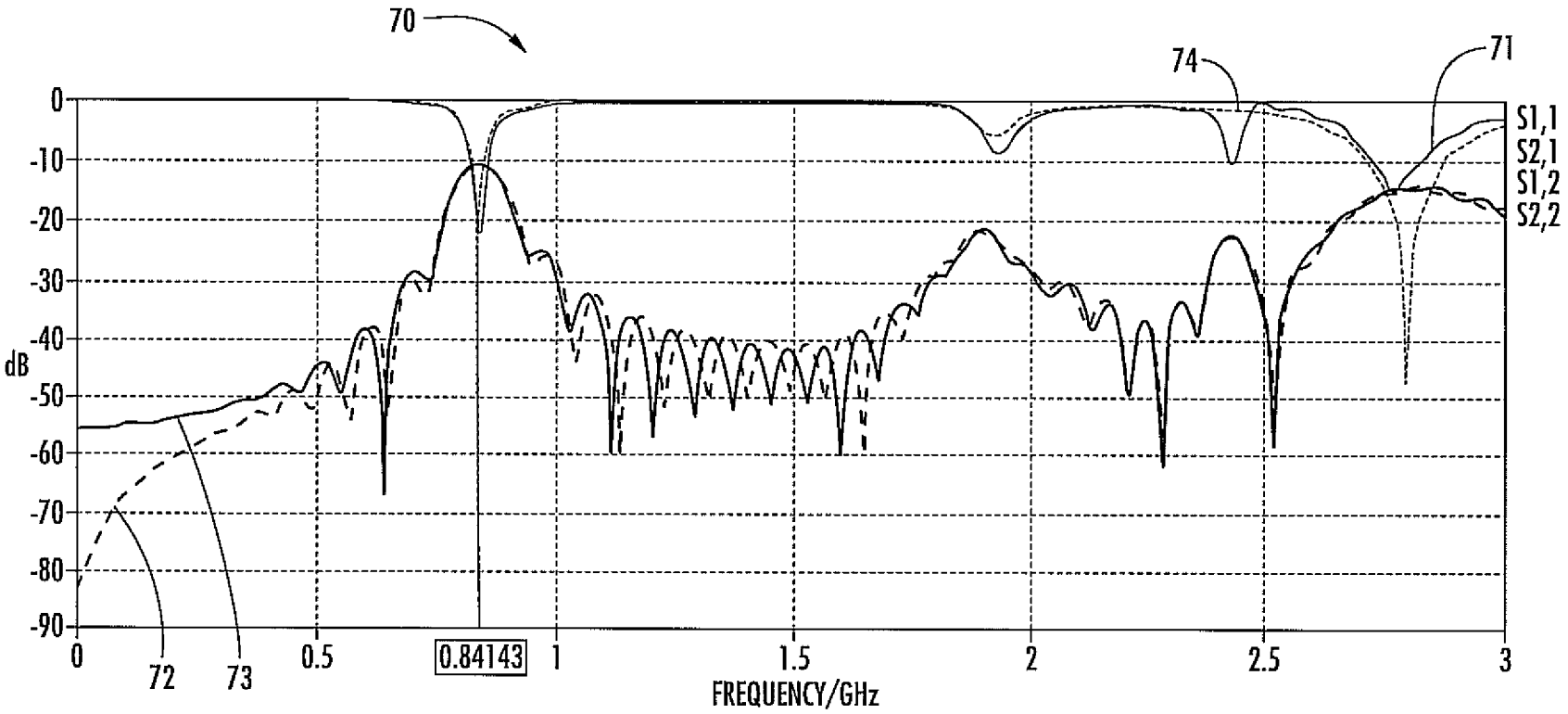
FIG. 3 is a graph of simulated S-parameters for the device of FIG. 1.

Referring now to the graph 70 in FIG. 3, simulated S-parameters are illustrated for the mobile wireless communications device 30 described above with respect to FIGS. 1-3. The S1,1 parameter 71 corresponds to a simulated value of −21.88, and the S2,1 parameter 72 corresponds to a value of −10.36. The simulated S1,2 parameter 73 had a corresponding value of −10.64, and the simulated S2,2 parameter 74 had a corresponding value of −20.32. At a frequency of 1.93 GHz, the radiated efficiency was simulated to be −0.1117 dB, while the total efficiency was simulated at −0.83 dB. At a frequency of 0.8 GHz, the radiated efficiency was simulated to be −0.05368 dB, while the total efficiency was simulated at −3.654 dB.

As will be appreciated by those skilled in the art, the gaps 56, 57 defined by the first and second electrically conductive arms 52, 53 and the discontinuity 42 may allow dirt, dust, and debris to enter the portable housing 31, and contribute to snagging. Additionally, the gaps 56, 57 and the discontinuity 42 may not be aesthetically pleasing.

Figure 4:
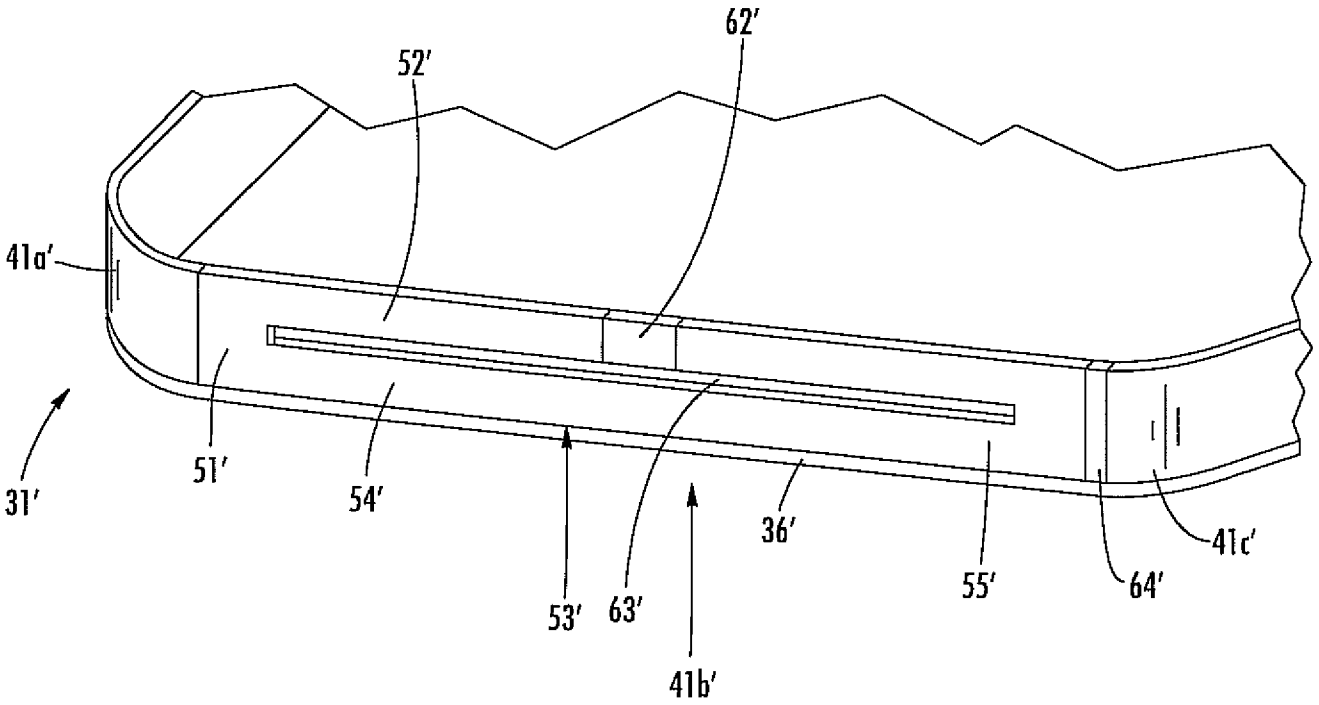
FIG. 4 is a detailed perspective view of a portion of the device of FIG. 1 including dielectric bodies in the gaps and the discontinuity according to another example embodiment.

Referring now to FIG. 4, according to another embodiment, to address the above, dielectric bodies 62', 63', 64' may be positioned within the gaps 56', 57' and the discontinuity 42', respectively. Each dielectric body 62', 63', 64' may be plastic, for example. In some embodiments, a relatively thin layer may be over or cover the electrically conductive section 41*b*' to provide increased protection and to give an overall look and feel of metal. Additionally, the dielectric bodies 62', 63', 64' may be formed as a single body. Alternatively, the dielectric bodies 62', 63', 64' may be formed a single body with the relatively thin layer.

Figure 5:
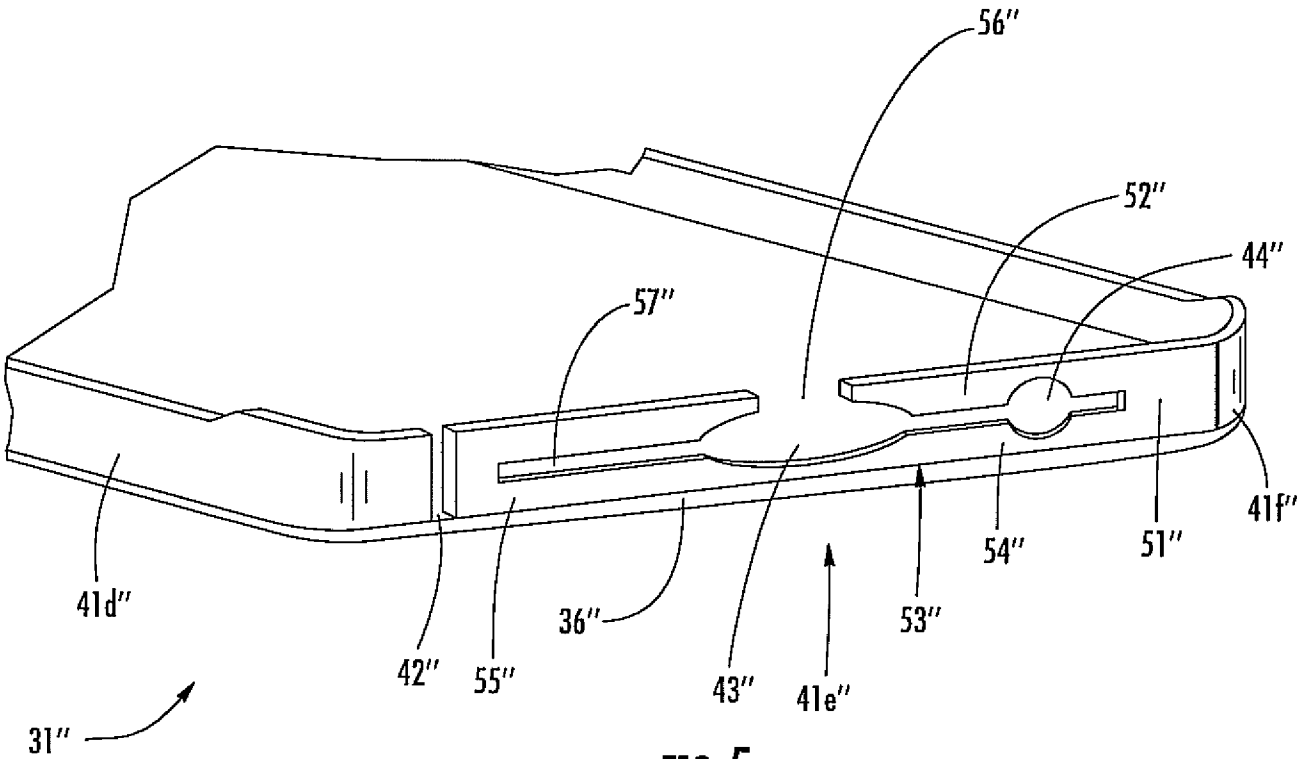
FIG. 5 is a detailed perspective view of a portion of a mobile wireless communications device according to another example embodiment.

Referring now to FIG. 5, in another embodiment a top of the portable housing 31" including electrical conductive sections 41*d*"-41*f*" is illustrated. The first and second electrically conductive arms 51", 52" each have an opening therein to receive a respective component therein. More particularly, a first opening 43" is formed or carved out for one component, for example, a power port, and a second opening 44" is formed for a second component, for example, an audio output jack. Illustratively, the first and second openings 43", 44" are formed from an edge defined by the gap 57". As will be appreciated by those skilled in the art, the length of the first and second electrically conductive arms 52", 53" may be adjusted to account for the openings 43", 44" therein, i.e., a lesser amount of electrically conductive material.

Advantageously, the electrically conductive segments 41*a*, 41*b* that are the portable housing 31 are used as an antenna radiator by forming both a vertical slot (i.e., gap 56) and a horizontal slot (i.e. gap 57) in the end of the portable housing 31. Thus, the mobile wireless communications device 30 may have improved antenna performance on at least one end of the mobile wireless communications device despite the presence of a relatively large grounded metal ring (i.e., the electrically conductive sections 41*a*-41*c* defining the perimeter of the portable housing 31) generally in the radiating area. In other words, a portable housing including the electrically conductive sections defining the perimeter of the portable housing typically reduces antenna performance. The base 51, and first and second electrically conductive arms 52, 53 advantageously uses one of the electrically conductive sections 41*b* defining the perimeter as the actual antenna radiator to improve antenna performance or reduce the effects of the other electrically conductive sections 41*a*, 41*c*.

Additionally, while the structure of the base 51, and first and second electrically conductive arms 52, 53 are described with respect to a single electrically conductive section 41*b*, it should be understood that more than one electrically conductive section may include a base and first and second electrically conductive arms, as described herein. For example, an electrically conductive section adjacent the top and an electrically conductive section adjacent the bottom of the portable housing may include a base and first and second electrically conductive arms.

A method aspect is directed to a method of making a mobile wireless communications device 30 that includes a portable housing 31 that includes electrically conductive sections 41*a*-41*c* defining a perimeter of the portable housing and configured to function as an antenna. The mobile wireless communications device 30 may further include a printed circuit board (PCB) 32 carried by the portable housing 31, and wireless transceiver circuitry 33 carried by the PCB and coupled to the antenna. The method includes forming one of the electrically conductive sections 42*b* to include a base 51, a first electrically conductive arm 52 extending from the base, and a second electrically conductive arm 53 having a proximal portion 54 parallel and spaced apart from the first electrically conductive arm.

Example components of a mobile wireless communications device 1000 that may be used in accordance with the above-described embodiments are further described below with reference to FIG. 6. The device 1000 illustratively includes a housing 1200, a keyboard or keypad 1400 and an output device 1600. The output device shown is a display 1600, which may comprise a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

Figure 6:
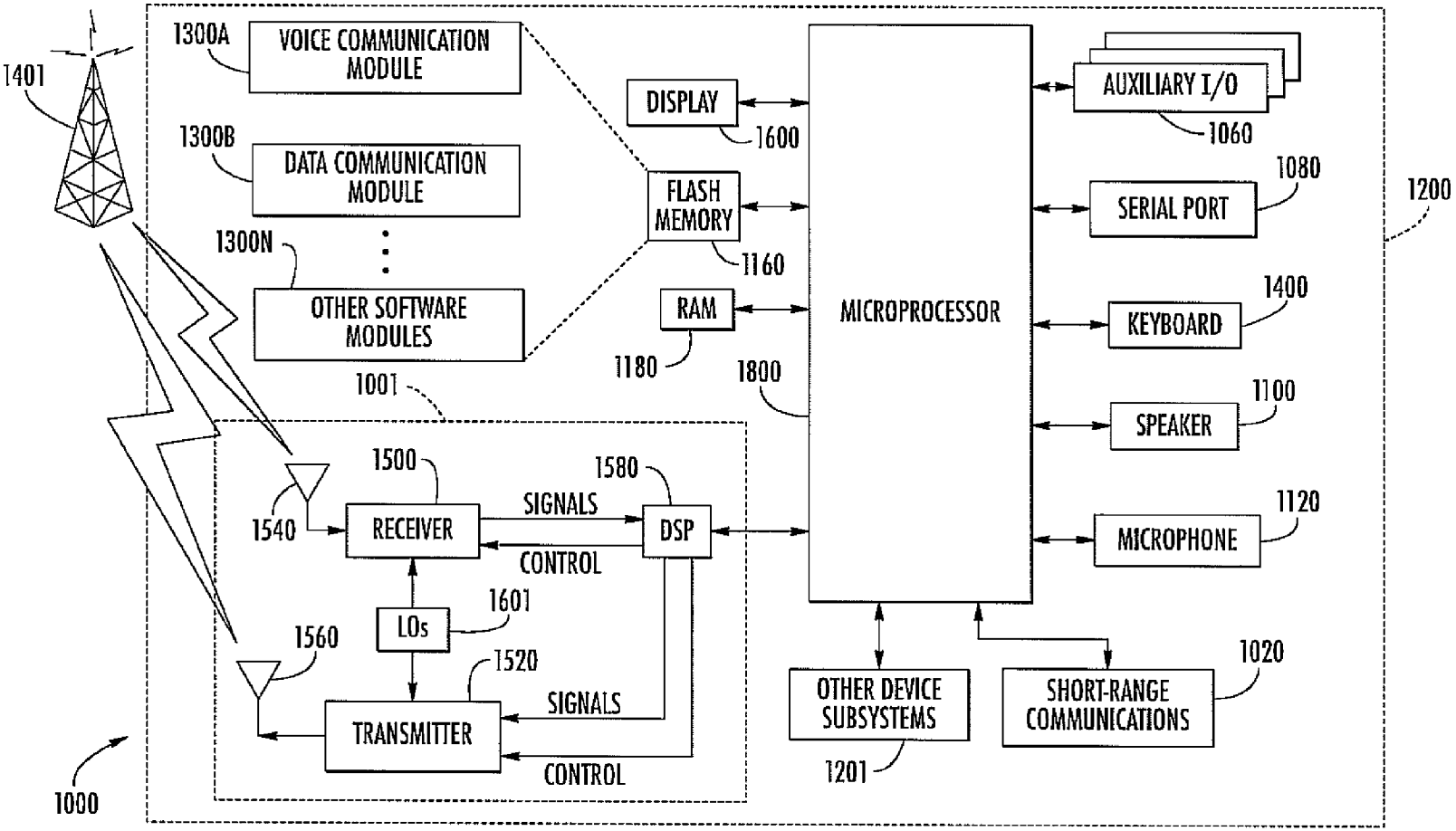
FIG. 6 is a schematic block diagram illustrating additional components that may be included in the mobile wireless communications device of FIG. 1.

In addition to the processing device 1800, other parts of the mobile device 1000 are shown schematically in FIG. 6. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a near field communications (NFC) sensor for communicating with a NFC device or NFC tag via NFC communications.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:

a portable housing comprising a plurality of electrically conductive sections defining a perimeter of said portable housing and configured to function as an antenna, one of said electrically conductive sections comprising a base, at least one port extending through the portable housing configured to receive a connector for an external component, a first electrically conductive arm extending from the base, and a second electrically conductive arm having a proximal portion parallel and spaced apart from said first electrically conductive arm, said second electrically conductive arm having a U-shaped distal portion coupled to the proximal portion aligned with said first electrically conductive arm and the proximal portion, said first and second electrically conductive arms positioned completely within and forming a portion of an end wall of the portable housing, and defining a vertical slot and a horizontal slot, the at least one port being disposed within the horizontal slot;

a printed circuit board (PCB) within said portable housing; and wireless transceiver circuitry carried by said PCB within said portable housing and coupled to the antenna.

2. The mobile wireless communications device of claim 1, wherein at least one pair of adjacent electrically conductive sections has a discontinuity therebetween.

3. The mobile wireless communications device of claim 2, further comprising at least one dielectric body within the discontinuity.

4. The mobile wireless communications device of claim 1, wherein the proximal portion being parallel and spaced apart from said first electrically conductive arm defines the horizontal slot; and further comprising a dielectric body in the horizontal slot.

5. The mobile wireless communications device of claim 1, wherein said first electrically conductive arm has an elongate shape.

6. The mobile wireless communications device of claim 1, wherein said first and second electrically conductive arms define a planar inverted F-antenna (PIFA).

7. The mobile wireless communications device of claim 1, wherein at least one of said first and second electrically conductive arms has an opening therein.

8. The mobile wireless communications device of claim 1, wherein said first and second electrically conductive arms are adjacent at least one of a top and a bottom of said portable housing.

9. The mobile wireless communications device of claim 1, wherein said plurality of electrically conductive sections is configured to function as a cellular antenna.

10. The mobile wireless communications device of claim 1, wherein the at least one port extending through the portable housing is a power port for receiving a power cable from the external component.

11. The mobile wireless communications device of claim 1, wherein the at least one port extending through portable housing is an audio port for receiving an audio cable from the external component.

12. A mobile wireless communications device comprising:

a portable housing comprising a plurality of electrically conductive sections defining a perimeter of said portable housing and configured to function as an antenna, at least one pair of adjacent electrically conductive sections having a discontinuity therebetween and comprising a base, at least one port extending through the portable housing configured to receive a connector for an external component, a first electrically conductive arm having an elongate shape and extending from the base, and a second electrically conductive arm having a proximal portion parallel and spaced apart from said first electrically conductive arm, said second electrically conductive arm having a U-shaped distal portion coupled to the proximal portion aligned with said first electrically conductive arm and the proximal portion, said first and second electrically conductive arms positioned completely within and forming a portion of an end wall of the portable housing and defining a vertical slot and horizontal slot, the at least one port being disposed within the horizontal slot;

a printed circuit board (PCB) within said portable housing; and wireless transceiver circuitry carried by said PCB within said portable housing and coupled to the antenna.

13. The mobile wireless communications device of claim 12, further comprising at least one dielectric body within the discontinuity.

14. The mobile wireless communications device of claim 12, wherein the proximal portion being parallel and spaced apart from said first electrically conductive arm defines the horizontal slot; and further comprising a dielectric body in the horizontal slot.

15. The mobile wireless communications device of claim 12, wherein the at least one port extending through the portable housing is a power port for receiving a power cable from the external component.

16. The mobile wireless communications device of claim 12, wherein the at least one port extending through portable housing is an audio port for receiving an audio cable from the external component.

17. A method of making a mobile wireless communications device comprising a portable housing comprising a plurality of electrically conductive sections defining a perimeter of the portable housing and configured to function as an antenna, the portable housing further comprising at least one port extending through the portable housing configured to receive a connector for an external component, a printed circuit board (PCB) within the portable housing, and wireless transceiver circuitry carried by the PCB within the portable housing and coupled to the antenna, the method comprising forming one of the electrically conductive sections to include a base, a first electrically conductive arm extending from the base, and a second electrically conductive arm having a proximal portion parallel and spaced apart from the first electrically conductive arm, the second electrically conductive arm being formed so that the second electrically conductive arm has a U-shaped distal portion coupled to the proximal portion and aligned with the first electrically conductive arm and the proximal portion, and the first and second electrically conductive arm being formed so that both the first and second electrically conductive arms are positioned completely within and form a portion of an end wall of the portable housing and define a vertical slot and a horizontal slot, the at least one port being disposed within the horizontal slot.

18. The method of claim 17, wherein at least one pair of adjacent electrically conductive sections is formed to have a discontinuity therebetween.

19. The method of claim 18, further comprising positioning at least one dielectric body within the discontinuity.

20. The method of claim 17, wherein the proximal portion being parallel and spaced apart from the first electrically conductive arm defines the horizontal slot; and further comprising positioning a dielectric body in the horizontal slot.

* * * * *